United States Patent [19]

Braly

[11] Patent Number: 5,040,279

[45] Date of Patent: Aug. 20, 1991

[54] METHOD FOR PRODUCING FREQUENCY MATCHED SETS OF COMPOSITE GOLF CLUB SHAFTS

[75] Inventor: Warren K. Braly, Torrington, Conn.

[73] Assignee: Brunswick Corporation, Skokie, Ill.

[21] Appl. No.: 259,989

[22] Filed: Oct. 19, 1988

[51] Int. Cl.[5] ..... B23Q 17/00; A63B 53/12

[52] U.S. Cl. ..... 29/407; 29/453; 73/579; 273/77 A

[58] Field of Search ..... 29/407, 428, 453, 525; 73/579; 273/77 A, 80 B

[56] References Cited

U.S. PATENT DOCUMENTS

| | | | |
|---|---|---|---|
| 3,395,571 | 8/1968 | Murdoch | 273/77 A |
| 3,871,649 | 3/1975 | Kilshaw | 273/77 A |
| 4,070,022 | 1/1978 | Braly | 273/77 A |
| 4,555,112 | 11/1985 | Masghati | 273/77 A |

*Primary Examiner*—Timothy V. Eley

*Attorney, Agent, or Firm*—Arthur Greif

[57] ABSTRACT

In the production of a matched set of golf clubs, the most accurate method for matching the flex of each shaft in the set is through the use of an electronic frequency analyzer which measures the vibrational frequencies of the shafts or clubs. With most high quality steel shafts, such frequency measurements are generally reproducible and serve as a reliable index of shaft flexibility. It has been found for some shafts, particularly for composite shafts, that frequency measurements taken along different cross-sectional diameters may vary. For such shafts, it has been found that frequency measurements will be reproducible, if the frequency measurement is made on the same diameter. The diameters used for such measurements are marked on the shaft and then employed in the construction of the golf club, such that the diameter is substantially perpendicular to the striking face of the club head.

4 Claims, 1 Drawing Sheet

METHOD FOR PRODUCING FREQUENCY MATCHED SETS OF COMPOSITE GOLF CLUB SHAFTS

TECHNICAL FIELD

This invention relates to a method for producing a frequency matched set of golf clubs, and is more particularly related to the determination of a reproducible frequency measurement for shafts which are cross sectionally asymmetric—such that the frequency so-measured can be reliably employed to produce a "frequency matched set" of shafts.

BACKGROUND ART

High quality golf club sets are produced and marketed in what is termed "frequency matched sets", each golf club being constructed such that the flexing characteristics of the club will provide the same degree of "feel" throughout the set. Although "feel" is somewhat subjective, it is generally well accepted that a golf club which provides proper "feel" will aid the golfer in achieving: (i) optimum club head velocity and club head position at the point of ball impact—providing better overall shots; and (ii) greater uniformity from shot to shot—both of which will contribute to lower total scores. U.S. Pat. No. 4,070,022, the disclosure of which is incorporated herein by reference, is directed to a method for accurately quantifying relative "feel", based on accurate determinations of the frequency of vibration of a specific shaft. After the frequency determinations are made, shafts are selected from a plurality of selected shafts in which the frequencies fall on a predetermined gradient formed by a plot of shaft frequency versus shaft length, in which shaft frequency increases as shaft length decreases. Subsequent mating of the shafts with weight-matched club heads, i.e., wood and iron heads, produces a set of matched golf clubs.

The utility of the method described in the '022 patent is, in part, based on the finding that frequency measurements of various shafts can be reproducible and therefore serve as a reliable index of shaft flexibility. Frequency measurement is generally accomplished by securing the butt end of the shaft in a clamp or chuck. A predetermined test weight is fixed to the tip end of the shaft, after which the shaft is plucked so as to cause it to vibrate. Reproducibility of such vibrating frequency is achieved by depressing the tip end to a predetermined stop (i.e., such that each shaft will have the same amplitude of vibration) and thereafter releasing the shaft such that the resulting oscillations may be measured utilizing an electronic counter unit. Utilizing this system, reproducibility of measurements of $+0.2$ cpm can be realized—at least with respect to the high quality steel shafts presently available.

It was found, however, when the same method was employed for the frequency measurement of composite (generally graphite) shafts, that reproducibility was poor or non-existent. Composite shafts are made of fiber, e.g., graphite, reinforced resin. The shafts are made by cross lapping various plies of reinforced fibers which have been impregnated with a resin. A cylindrical steel mandrel, which has been precoated with a release agent, is then rolled between flat planes—such that the resin-impregnated, woven fabrics are rolled upon the mandrel and upon the fabric itself a number of times. After the multiple plies are wrapped around the mandrel to achieve the desired diameter, the entire unit is wrapped to maintain the plies tightly wrapped during the subsequent curing procedure. It is therefore readily seen, unless special precautions are taken, that the resulting composite shaft will not be completely uniform in cross section. This cross sectional non-uniformity results in a tube in which the flex (frequency) will vary along different lines of the shaft, parallel to the longitudinal axis of the shaft. Various manufacturers of shafts have labeled their product as "frequency matched". While there is no industry-wide standard, that term is generally understood to define a set of clubs in which a plot of shaft frequency, "f", versus shaft length, "l", will fall on essentially a straight line (i.e., $f=ml+b$) with a variation not exceeding $\pm 1.0\%$, preferably not exceeding $+1$ cpm. The graphite products that are presently marketed exhibit far greater discrepancies in frequency.

DISCLOSURE OF INVENTION

It has been generally assumed that the poor reproducibility of frequency measurement for a given composite shaft, which results from the cross sectional non-uniformity of the shaft, is inherent in the products presently available and that truly frequency matched shafts must await new manufacturing methods which will yield a more uniform cross section. It has now been found, notwithstanding such cross sectional non-uniformity, that there exist certain chordal planes (i.e., a plane passing through the longitudinal axis of the shaft as well as through two diametrically opposed points on the circumference of the shaft) which will yield consistent frequency measurements, if the shaft is caused to oscillate in such plane. The consistency of the frequency measurement taken in such a "oscillatory" chordal plane can then be employed to produce a frequency matched set of golf clubs, if the club head is secured to the shaft such that the striking face of the club head is perpendicular to the chordal plane employed for the frequency so-determined. The applicability and advantages of this finding will be better appreciated by referring to the following more detailed description, the appended claims, and the drawings.

BRIEF DESCRIPTION OF THE DRAWINGS

FIG. 1A illustrates the wobbling "vibration" pattern exhibited by a shaft plucked along some chordal planes, while

MODES FOR CARRYING OUT THE INVENTION

Figure 1A:
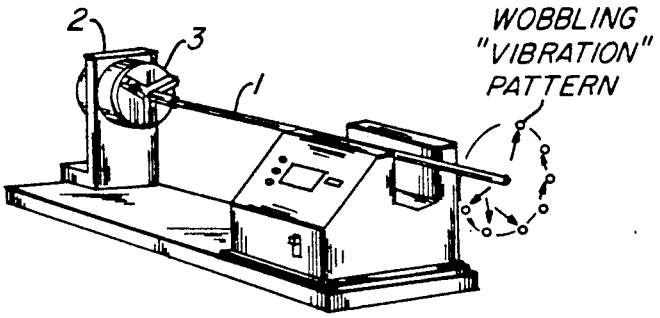
Figure 1B:
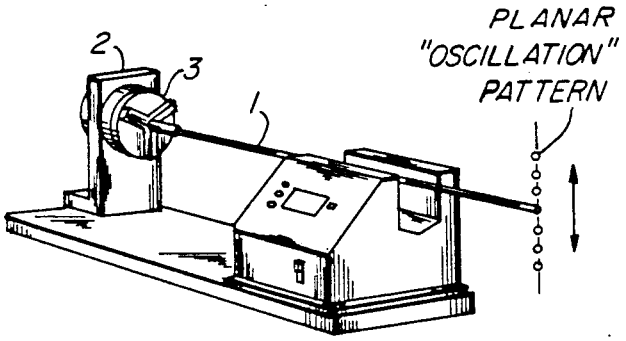
FIG. 1B illustrates the "oscillation" behavior desired, i.e., in which the plucking action results in essentially planar oscillation.

Initial attempts to produce frequency matched sets of composite golf club shafts, utilizing the frequency measurement system of the '022 patent, resulted in either: (i) a vibration pattern oscillating in varying planes or wobbling (FIG. 1A), such that no reading on the electronic counter was possible; or (ii) if essentially planar vibration was encountered, the variation in frequency from test to test varied by as much as $+5$ cpm. Cross sectional cuts were made along various lengths of an "initial set" of composite shafts received from a manufacturer of composite shafts. Such cuts showed cross sections in which the thickness of the tubing varied both along the same cross sectional cut and from cut to cut. It was initially postulated, as a result of such non-uniform cross section, that such composite shafts could not be employed for the production of frequency matched sets of golf clubs. To determine if more uniform cross sections could be utilized for the production of frequency matched set of graphite shafts, a request was made of the manufacturer to modify his layup techniques—such that comparably uniform cross sections could be achieved. It was also postulated, because of the lay-up technique employed in the manufacture of such graphite shafts, that a predominant seam may exist in the shaft—such that if the shaft were caused to oscillate in the plane of that seam, frequency results may be more uniform. It was not possible to visually determine the location of a predominant seam in a completely finished shaft. Shafts 1 were therefore clamped within the frequency measuring device 2, and the frequency was measured along various circumferential points to determine if such a seam could be detected by frequency measurement. As a result of numerous measurements made by rotating the shaft within the clamp 3, it was determined, when the shaft was clamped in settings which yield planar oscillation, FIG. 1B (as opposed to the wobbling vibration illustrated in FIG. 1A), that readings taken along those points were, in fact, reproducible. Comparative examples of frequency measurements made on two of an "initial set" of shafts are shown in Table I. The readings shown in Column A are those in which the shaft was clamped, a reading taken, thereafter unclamped, rotated approximately ¼ turn, and another reading taken. Column B shows results of four different readings taken utilizing the same point, i.e., the point in which the first reading was taken in Column A. The relative reproducibility of results using the same point (Column B) is clearly evident. Thus, whereas four readings along different planes for Shafts 1 and 2 yielded a frequency spread, Δ, of 5.2 cpm and 4.1 cpm, respectively; the spread, $\Delta_c$, exhibited for the same shafts utilizing a common point was 0.2 cpm (comprised of four readings—i.e., point "a" on the circumference) for both shafts.

TABLE I

| | A | | | B | | |
|---|---|---|---|---|---|---|
| Shaft # | Point on Circumfer. | Freq. (cpm) | Δ | Point on Circumfer. | Freq. (cpm) | $\Delta_c$ |
| 1 | a | 247.0 | | a | 247.2 | |
| | b | 249.6 | | a | 247.1 | 0.2 |
| | c | 252.3 | 5.3 | a | 247.2 | |
| | d | 250.0 | | a | 247.2 | |
| 2 | a | 253.4 | | a | 253.5 | |
| | b | 256.4 | 4.1 | a | 253.5 | 0.2 |
| | c | 253.1 | | a | 253.4 | |
| | d | 252.3 | | a | 253.6 | |

Based on the results obtained from the "initial set" of shafts, it was further postulated that such enhanced reproducibility could be achieved utilizing a common chordal plane, i.e., (i) the same point on the circumference, or (ii) a point diametrically opposed (i.e., 180°) to the first point. Additional tests were performed on a second set of shafts in which the manufacturer, utilizing proprietary lay-up techniques, provided shafts with far improved cross sectional uniformity. Prior to testing, an arbitrary starting point (0°) and three other points, 90° apart, were marked on the shaft circumference; such that readings on a common chordal plane (i.e., points 180° apart) could be compared. Even with the enhanced uniformity of results shown for this specially produced set of shafts, the advantages of using a common chordal plane are readily evident from the results reported in Table II. Thus, while the new set exhibits a much tighter range of results (i.e., a Δ of from 0.7 cpm to 3.0 cpm) this range is nevertheless far greater than for the same shafts in which a common chordal plane was utilized (i.e., readings on the 0° and 180° points, as well as those on the 90° and 270° points), providing a measurement range, $\Delta_c$, of from 0.0 to 0.4 cpm.

TABLE II

| | Point on Circumference | | | | | |
|---|---|---|---|---|---|---|
| Shaft # | 0° | 90° | 180° | 270° | Δ | $\Delta_c$ |
| | (Freq. values in cpm) | | | | | |
| 3 | 206.9 | 207.4 | 206.6 | 207.6 | 1.0 | .3 |
| 4 | 207.0 | 209.0 | 207.0 | 209.0 | 2.0 | .0 |
| 5 | 209.3 | 211.8 | 209.0 | 212.0 | 3.0 | .3 |
| 6 | 207.2 | 207.8 | 206.9 | 208.2 | 1.3 | .4 |
| 7 | 209.4 | 207.4 | 209.5 | 207.7 | 2.1 | .3 |
| 8 | 208.4 | 207.8 | 208.4 | 207.7 | .7 | .1 |
| 9 | 207.2 | 208.1 | 207.6 | 208.1 | .9 | .4 |
| 10 | 208.5 | 207.9 | 208.7 | 207.8 | .9 | .2 |
| 11 | 209.0 | 208.0 | 208.8 | 207.9 | 1.1 | .2 |

Figure 2:
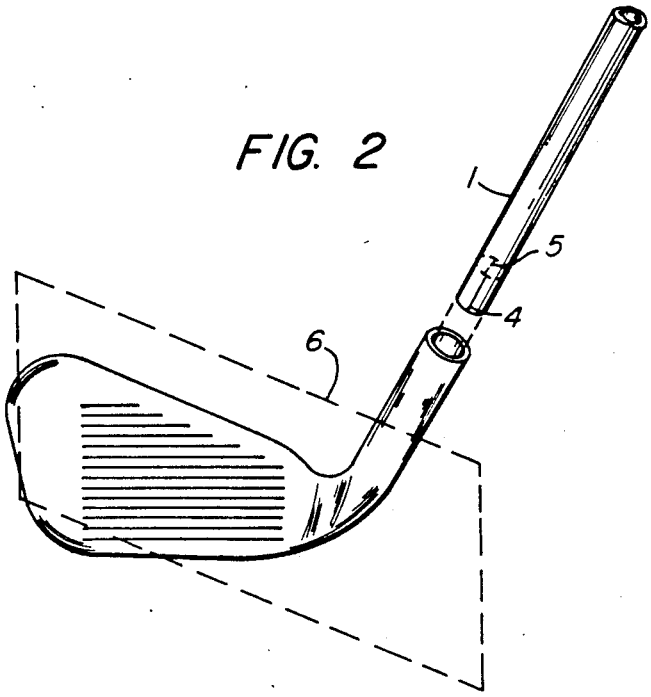
FIG. 2 illustrates how the oscillatory chordal plane used for determining frequency is marked and employed for assemblage into a golf club.

When a shaft production method is employed which results in a reasonably well defined seam or spline, that spline can be premarked and utilized in the frequency measuring device to provide planar vibration—thereby determining the point upon which the frequency measurement will be taken and subsequently utilized for the production of a matched set of golf shafts. The instant procedure can, however, be employed for any shafts which are cross sectionally asymmetric, i.e., a shaft in which the flex varies along different shaft lines parallel to its longitudinal axis. In those cases where no well defined seam exists or has not been premarked, the shaft can be inserted into the chuck of the frequency measuring device and plucked to set it in vibration. If the pattern is essentially planar or oscillatory, that setting can be marked and utilized for determining the frequency of the shaft. If, on the other hand, the shaft vibrates in various planes (FIG. 1A), the shaft would be unclamped, rotated, and reclamped until a setting is achieved which yields planar oscillation. Referring to FIG. 2, that setting can then be employed for measuring the frequency of the shaft 1, and marked to define a point 4 on the chordal diameter 5, and the frequency specifically associated with that chordal diameter. Thereafter, during assembly of a matched set, in which the frequency of that shaft is employed to fall on a predetermined curve, the desired accuracy will be achieved in the finished set of clubs by setting the chordal diameter 5, so that it is perpendicular to the plane 6 formed by the striking face of the club head. Otherwise, as seen from the data above, the actual flex of the shaft when striking the golf ball could differ by 5 cpm or more, even though the measurement on the shaft would have suggested that it is "perfectly" matched.

I claim:

1. In the production of tubular shafts used for the assembly of a frequency matched set of golf club shafts, wherein one end of a shaft used in the set is clamped and the other, cantilevered end is depressed a defined distance and released, so as to cause the shaft to oscillate, the frequency of such oscillation is measured, and such frequency is thereafter utilized to form a set of shafts that fall on a curve formed by a plot of shaft frequency (f) versus shaft length (l), the improvement for shafts which are not symmetric about their longitudinal axis, which comprises marking a point on the shaft which falls within the plane in which the shaft was so-oscillated, whereby the point so-marked defines the "chordal diameter" of the shaft having the frequency so-measured, which, when assembled in a golf club, will be substantially perpendicular to the striking face of the club head.

2. The method of claim 1, wherein club heads are secured to the shafts in the set, each such club head having a planar striking surface, and the club heads are secured such that the striking surface is perpendicular the chordal diameter "so-marked, whereby the so-produced set of shafts having club heads attached thereto will fall on a curve formed by a plot of frequency versus shaft length.

3. The method of claim 1, wherein the clamped end is the butt end of the shaft, and the curve is defined by the straight line equation $f=ml+b$, wherein "m" is the slope of the line, "l " is the length of the shaft, and "b" is the intercept of the "f" axis.

4. A set of at least six composite shafts produced by the method of claim 3, the length of each shaft within the set differs by at least one-half inch from each other, and the frequency of each shaft is not more than 1 cpm from said straight line, wherein the frequency measured utilizing said chordal diameter is employed as the frequency utilized to form said set of shafts.

* * * * *

UNITED STATES PATENT AND TRADEMARK OFFICE

CERTIFICATE OF CORRECTION

PATENT NO. : 5,040,279

DATED : August 20, 1991

INVENTOR(S) : Warren K. Braly

It is certified that error appears in the above-indentified patent and that said Letters Patent is hereby corrected as shown below:

In column 5, delete in line 6, the "," after "so-measured" and insert a "." therefor.

In column 5, delete lines 7, 8, and 9, i.e., "which, when assembled in a golf club, will be substantially perpendicular to the striking face of the club head."

Signed and Sealed this

Third Day of February, 1998

*Attest:*

*Attesting Officer*

BRUCE LEHMAN

*Commissioner of Patents and Trademarks*